US007682163B2

(12) United States Patent
Hou et al.

(10) Patent No.: US 7,682,163 B2
(45) Date of Patent: Mar. 23, 2010

(54) CONNECTOR

(75) Inventors: Pin-Yuan Hou, Hsin-Tien (TW); Mei-Hui Wang, Hsin-Tien (TW)

(73) Assignee: Advanced Connectek Inc. (TW)

( * ) Notice: Subject to any disclaimer, the term of this patent is extended or adjusted under 35 U.S.C. 154(b) by 0 days.

(21) Appl. No.: 12/394,936

(22) Filed: Feb. 27, 2009

(65) Prior Publication Data

US 2009/0305532 A1 Dec. 10, 2009

(30) Foreign Application Priority Data

Jun. 6, 2008 (TW) ..... 97121072 A

(51) Int. Cl.
*H01R 12/00* (2006.01)

(52) U.S. Cl. ..... 439/79

(58) Field of Classification Search ..... 439/79, 439/660, 733.1, 924.1

See application file for complete search history.

(56) References Cited

U.S. PATENT DOCUMENTS 7,588,445 B2 * 9/2009 He et al. ..... 439/79
7,591,654 B2 * 9/2009 Neumetzler ..... 439/79
7,591,683 B2 * 9/2009 Zhang et al. ..... 439/638
7,611,387 B1 * 11/2009 Zhang ..... 439/660

* cited by examiner

*Primary Examiner*—Khiem Nguyen
(74) *Attorney, Agent, or Firm*—Hershkovitz & Associates, LLC; Abraham Hershkovitz

(57) ABSTRACT

A connector has an insulative housing, a plurality of terminals and a metal shell. Each terminal has a soldering section. The soldering sections of a power terminal and a grounding terminal are the outermost terminals and are located outside remaining terminals instead of being located respectively between the soldering sections of signal transmitting or receiving terminals. The outermost soldering sections of the power and grounding terminals prevent the interference with the signal transmitting and receiving terminals during signal transmission.

19 Claims, 24 Drawing Sheets

100

100a

CONNECTOR

BACKGROUND OF THE INVENTION

1. Field of the Invention

The present invention relates to a connector, and more particularly to a connector that may be an SMT (Surface Mount Technology) type or T/H (Through Hole) type. Connectors of the two types use a same mold to reduce the manufacturing cost of the connectors.

2. Description of Related Art

USB (Universal Serial Bus) connectors are the most common and popular connectors. Computers and peripherals usually have USB connectors for data transmission. USB-IF (USB Implementers Forum) has started to develop a USB 3.0 protocol to replace the prevailing USB 2.0 protocol.

With reference to FIGS. 1 and 2, a T/H type USB 3.0 connector provisionally set by the USB-IF has an insulative housing (90), a plurality of terminals (1*a*-9*a*) and a metal shell. The terminals (1*a*-9*a*) are mounted through the insulative housing (90). The metal shell covers the insulative housing (90) and terminals (1*a*-9*a*).

The terminals (1*a*-9*a*) are the T/H type and each terminal has a soldering section that may be mounted through a mounting hole of a printed circuit board (PCB). The soldering sections of the terminals (1*a*-9*a*) disposed in a staggered arrangement, as shown in FIG. 2. The definitions of the terminals (1*a*-9*a*) are as the following table.

TABLE 1

| Terminal | Definition |
|---|---|
| Terminal (9a) | STP_Tx+ |
| Terminal (1a) | PWR |
| Terminal (8a) | STP_Tx− |
| Terminal (2a) | UTP_D− |
| Terminal (7a) | STP_Rx_Drain |
| Terminal (3a) | UTP_D+ |
| Terminal (6a) | STP_Rx+ |
| Terminal (4a) | GND_PWRrt |
| Terminal (5a) | STP_Rx− |

With further reference to FIGS. 3 and 4, a SMT type USB 3.0 connector has the soldering sections of power and grounding terminals (1*a*, 4*a*) being flat and Z-shaped and remaining soldering sections being flat and straight to make all the soldering sections of the terminals (1*a*-9*a*) disposed in a straight line. The definitions of the terminals (1*a*-9*a*) are as shown in the aforementioned Table 1.

As shown in FIGS. 1 to 4 and Table 1, the soldering section of the power transmitting terminal (1*a*) is between the soldering sections of two signal transmitting terminals (9*a*, 8*a*) so that the power transmitting terminal (1*a*) interferes with the signal transmitting terminals (9*a*, 8*a*) and reduce the stability of transmitting signals. Similarly, the soldering section of the grounding terminal (4*a*) is between the soldering section of two signal receiving terminals (6*a*, 5*a*) so that the grounding terminal (4*a*) interferes with the signal receiving terminals (6*a*, 5*a*) and disadvantages the signal receiving stability.

Furthermore, the flat and Z-shaped sections of the terminals (1*a*, 4*a*) of the SMT type connector is formed by a specific mold different from the mold for manufacturing the terminals of the T/H type connector. Therefore, the terminals of the SMT type and the T/H type connectors cannot be manufactured by the same mold, which increases the manufacturing cost of the connector.

To overcome the shortcomings, the present invention provides a connector to mitigate or obviate the aforementioned problems.

SUMMARY OF THE INVENTION

The main objective of the invention is to provide a connector that may be an SMT type or T/H type. Connectors of the two types use a same mold to reduce the manufacturing cost of the connectors.

A connector in accordance with the present invention comprises an insulative housing, a plurality of terminals and a metal shell. Each terminal has a soldering section. The soldering sections of a power terminal and a grounding terminal are the outermost terminals and are located outside remaining terminals instead of being located respectively between the soldering sections of signal transmitting or receiving terminals. The outermost soldering sections of the power and grounding terminals prevent the interference with the signal transmitting and receiving terminals during signal transmission.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
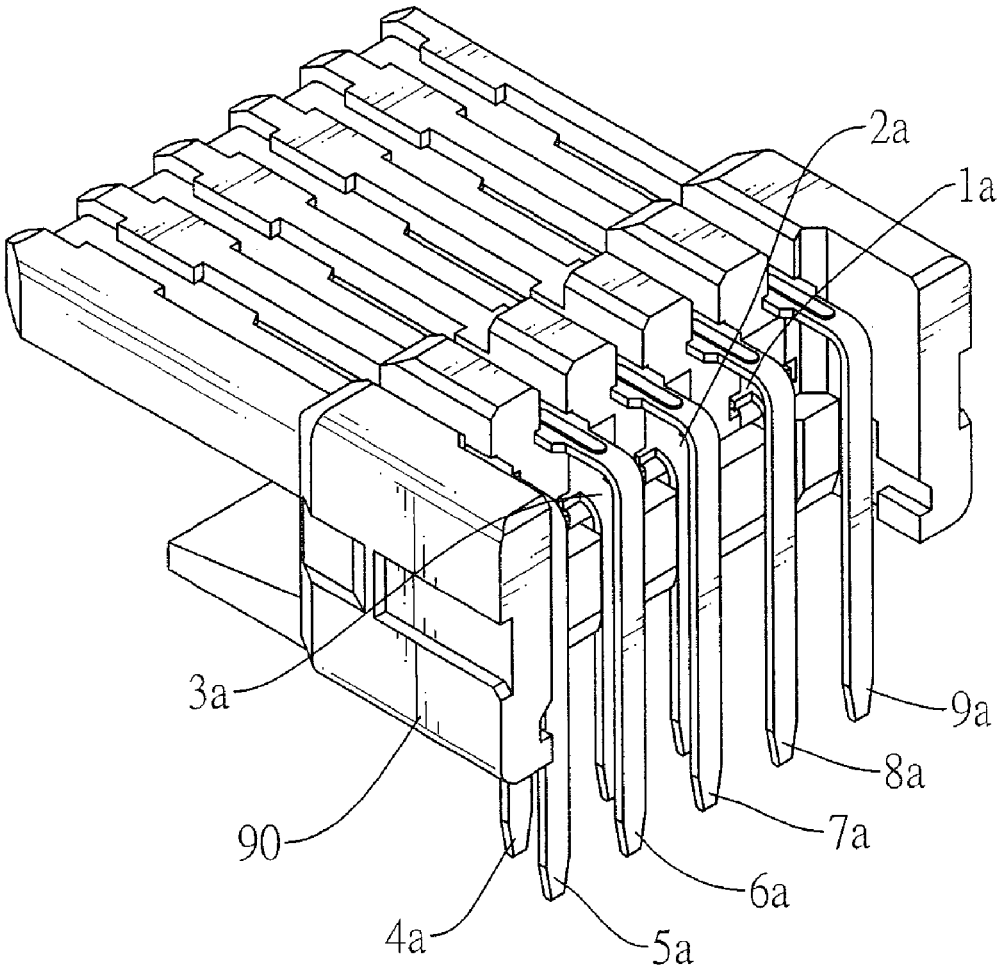
FIG. 1 is a perspective view of a conventional T/H type connector in accordance with the prior art.
Figure 2:
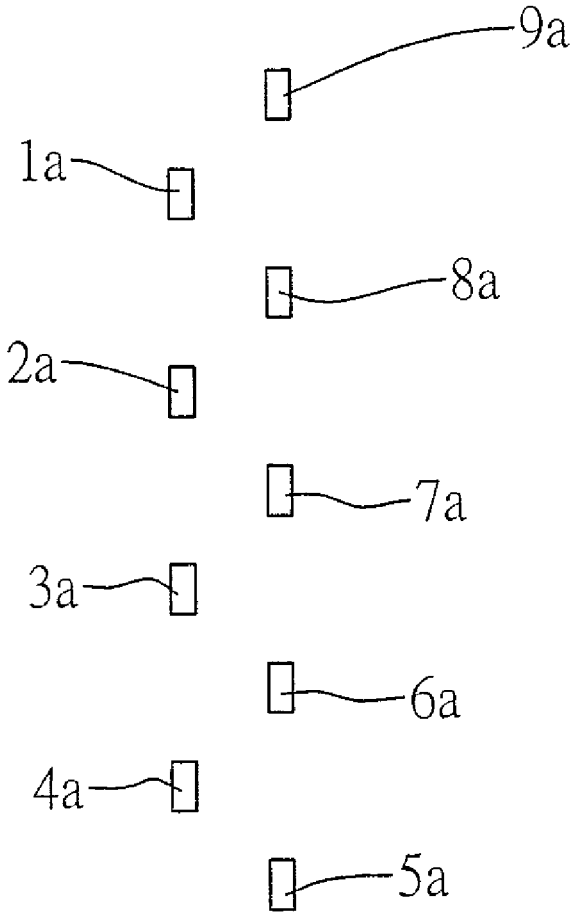
FIG. 2 is a footprint diagram showing the arrangement of the soldering sections of the terminal of the T/H type connector in FIG. 1.
Figure 3:
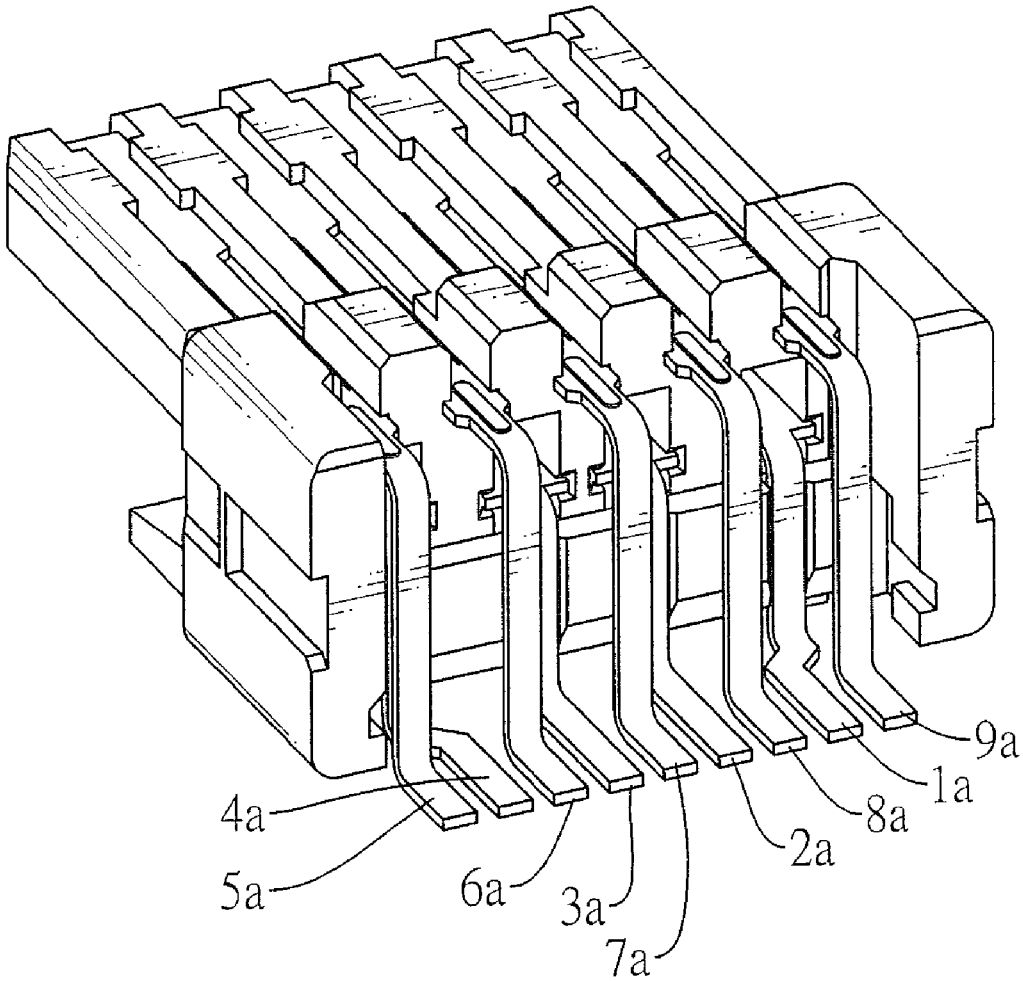
FIG. 3 is a perspective view of a conventional SMT type connector in accordance with the prior art.
Figure 4:
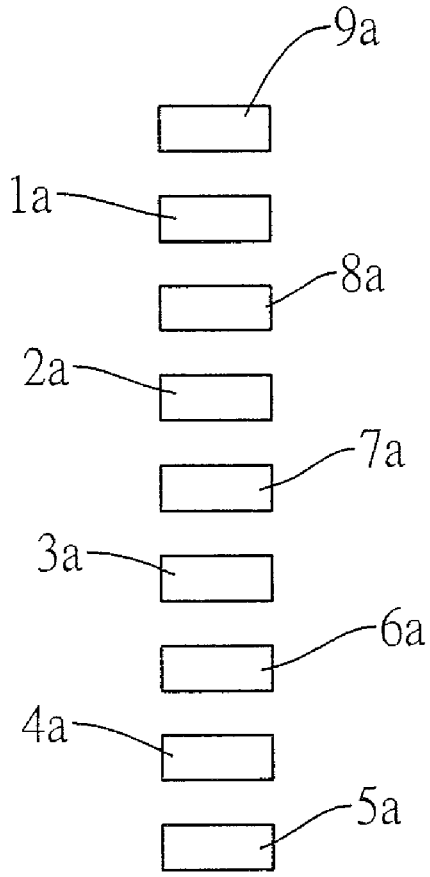
FIG. 4 is a footprint diagram showing the arrangement of the soldering sections of the terminal of the SMT type connector in FIG. 3.
Figure 5:
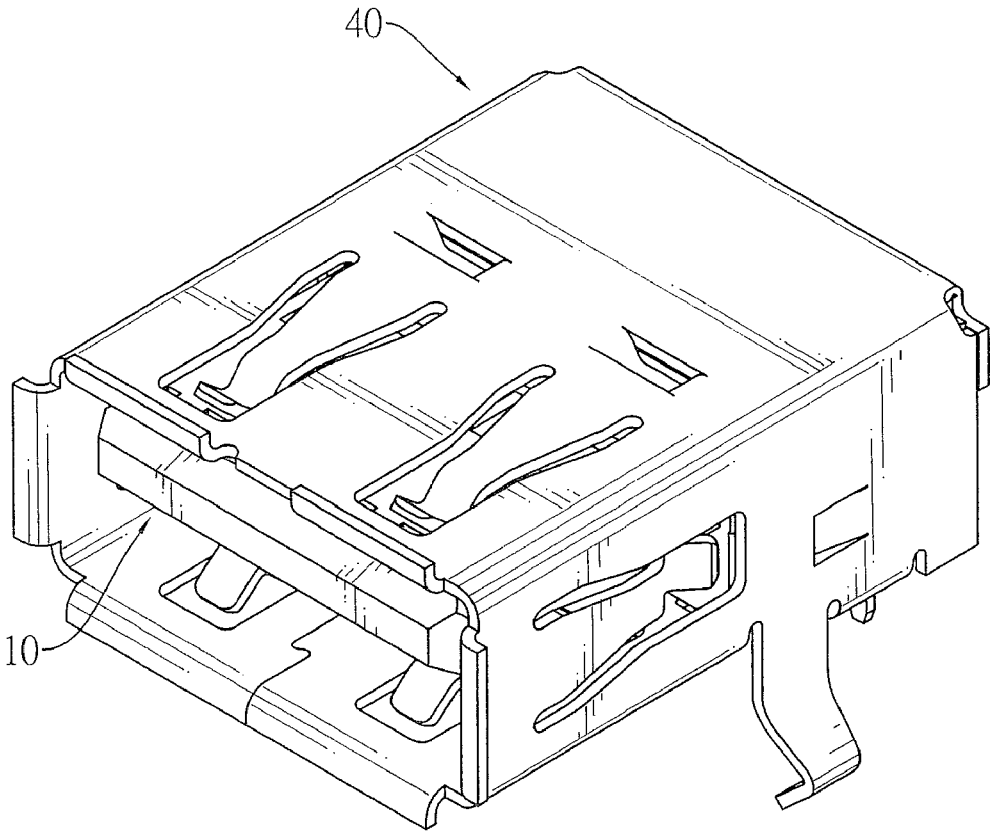
FIG. 5 is a perspective view of a T/H type connector in accordance with the present invention.
Figure 6:
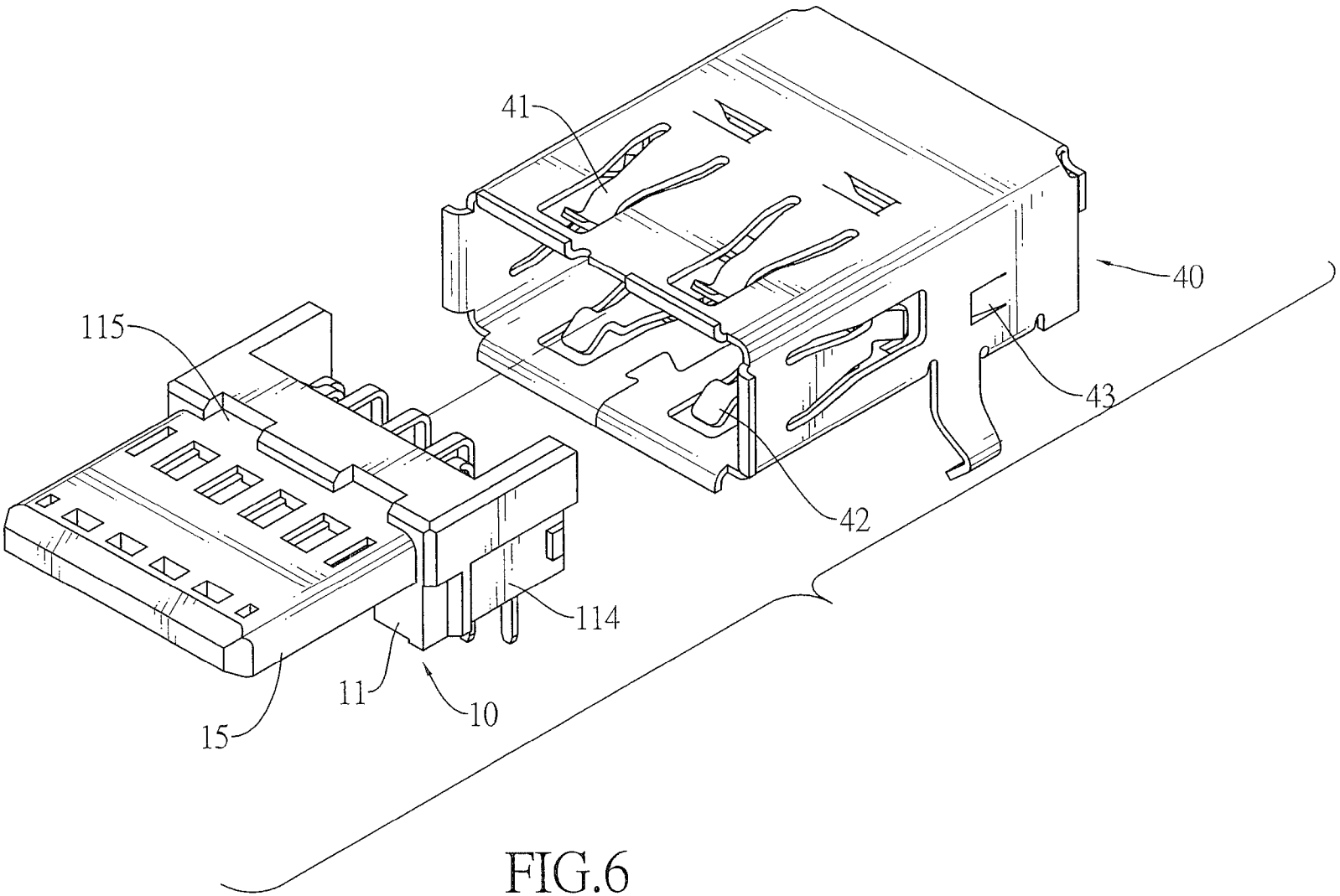
FIG. 6 is a partially exploded perspective of the connector in FIG. 5.
Figure 7:
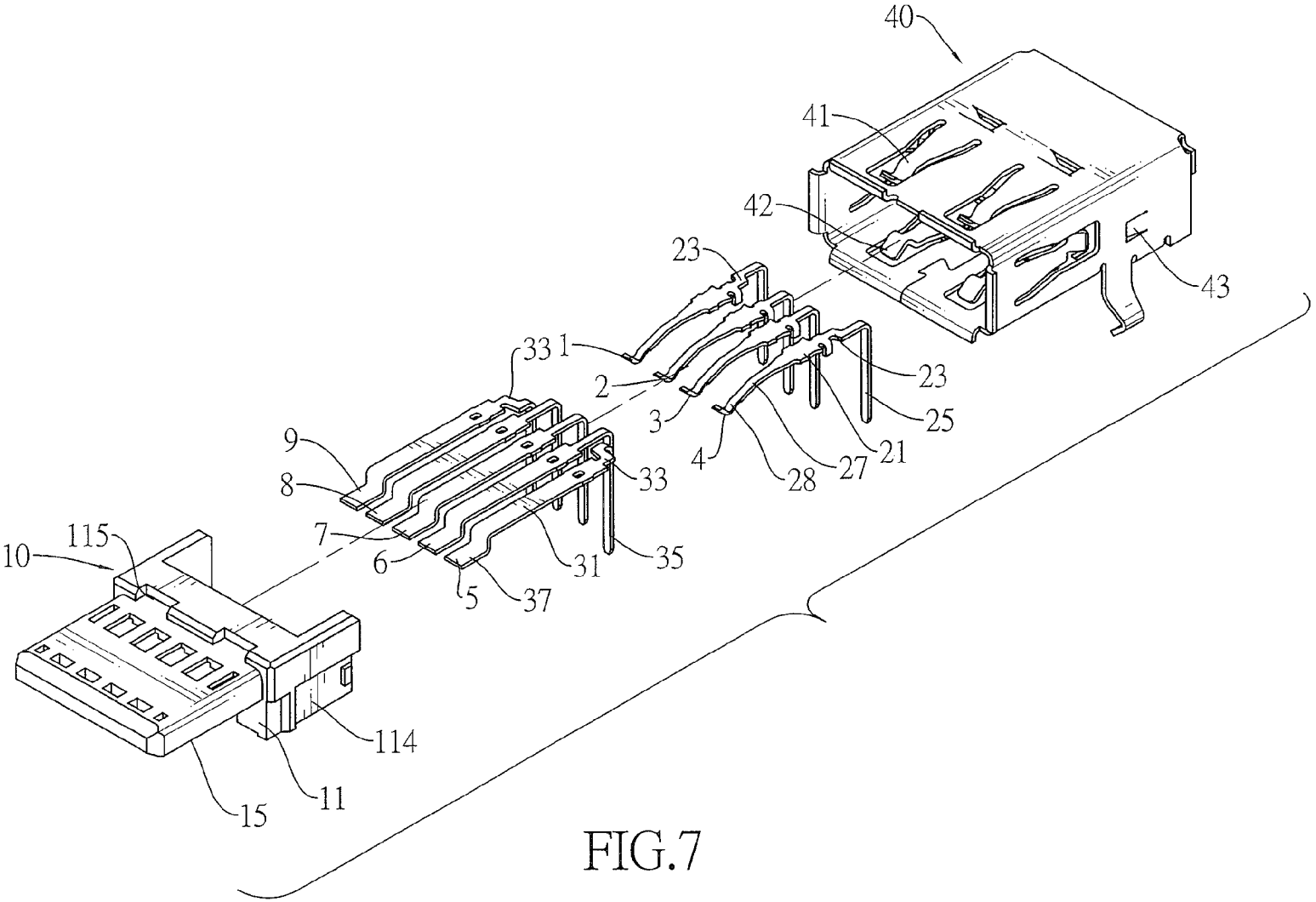
FIG. 7 is an exploded perspective view of the connector in FIG. 5.
Figure 8:
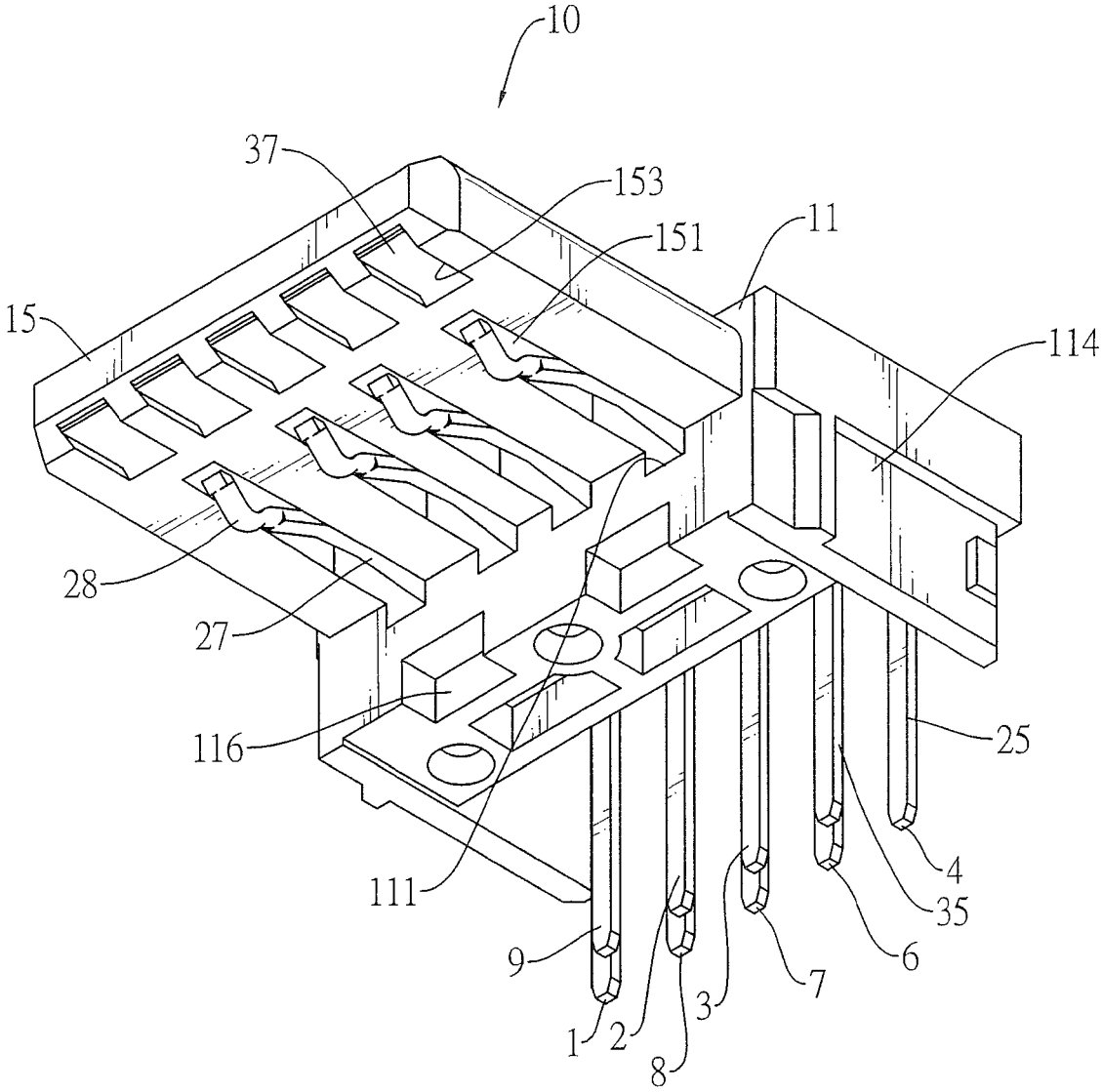
FIG. 8 is a bottom perspective view of the connector in FIG. 5 without the metal shell.
Figure 9:
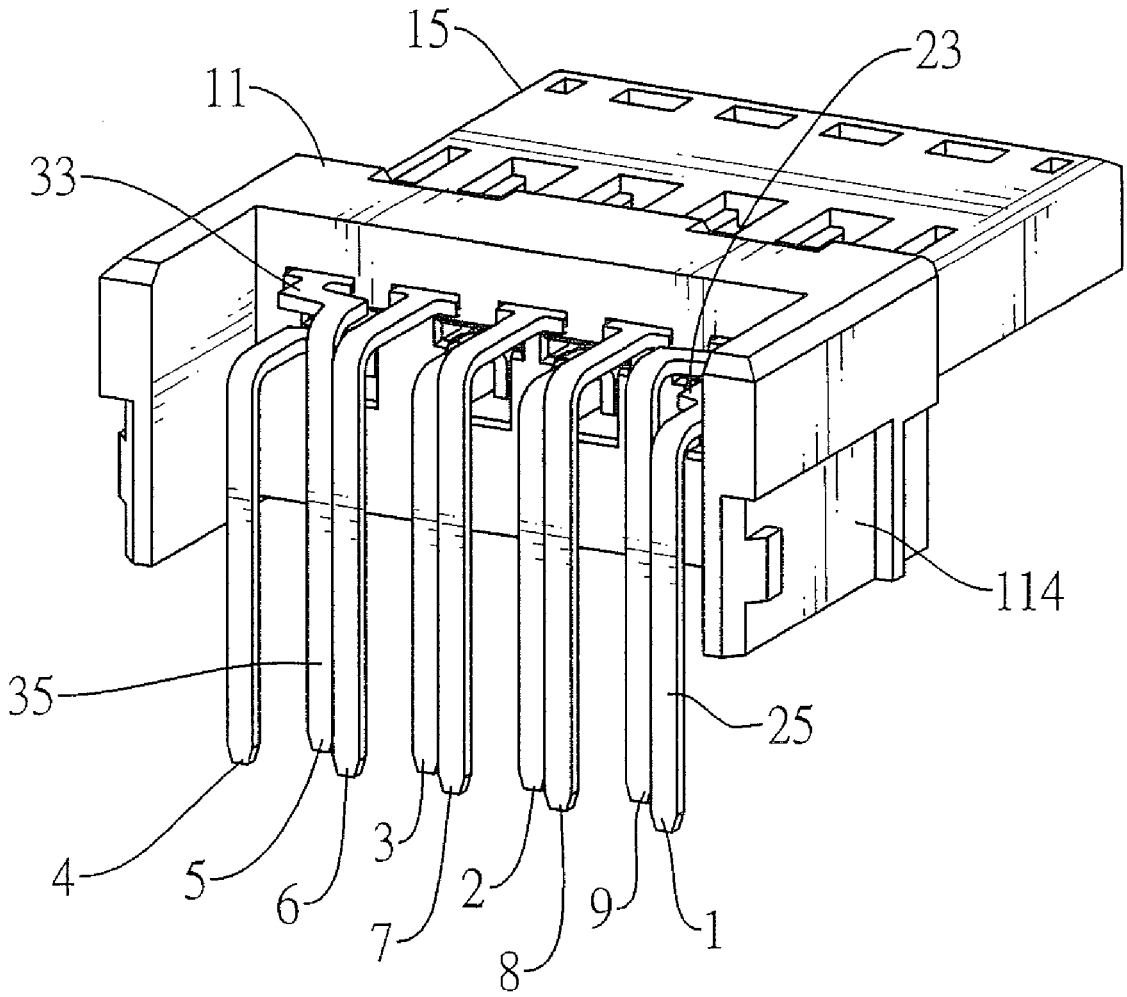
FIG. 9 is a rear perspective view of the connector in FIG. 8.
Figure 10:
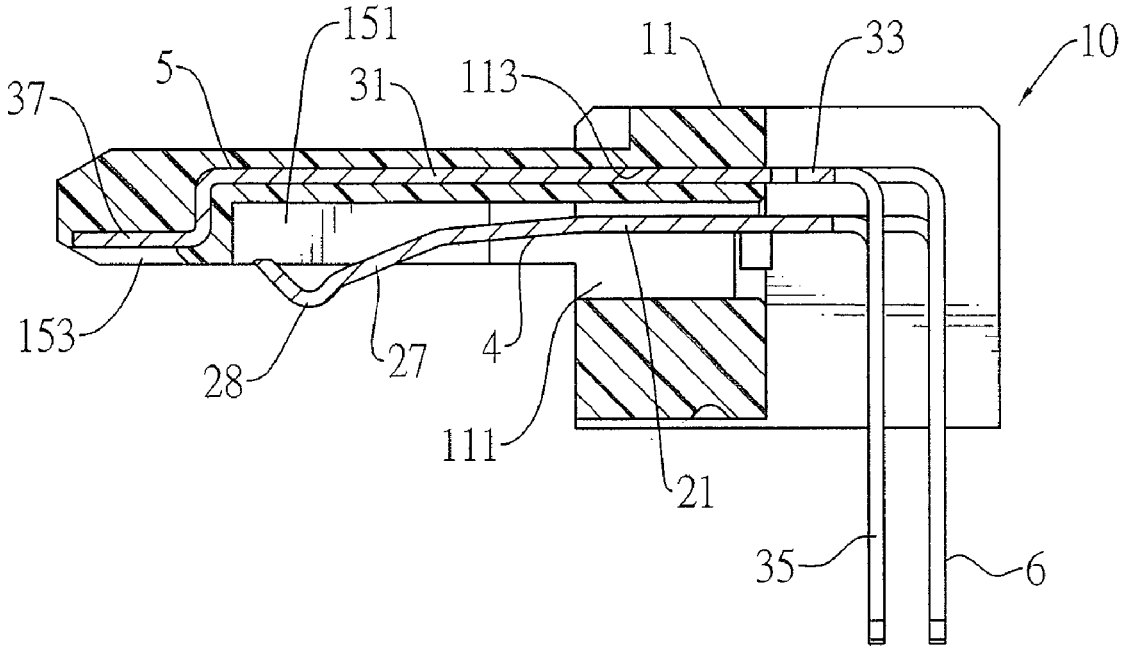
FIG. 10 is a cross sectional side view of the connector in FIG. 8.
Figure 11:
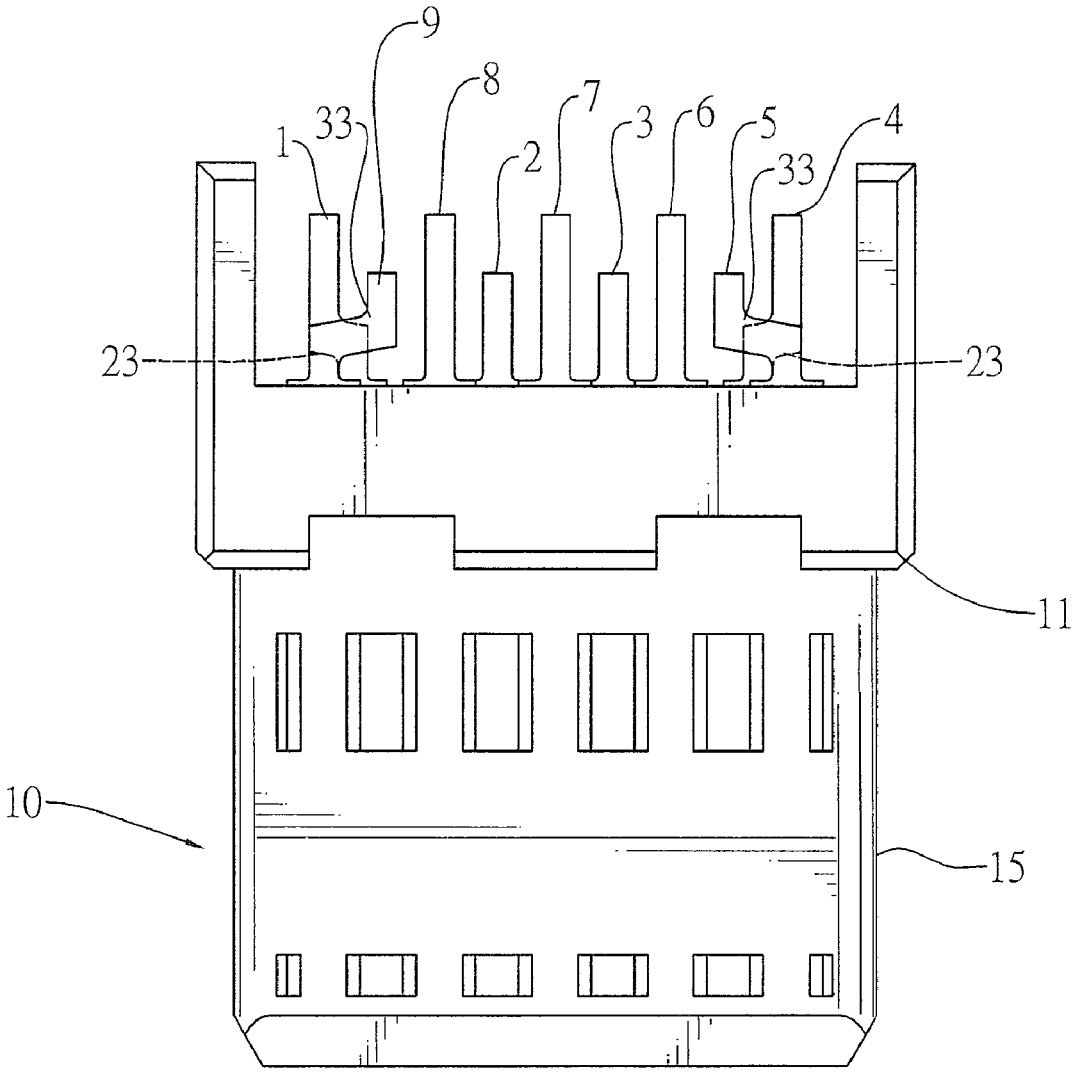
FIG. 11 is a top view of the connector in FIG. 8.
Figure 12:
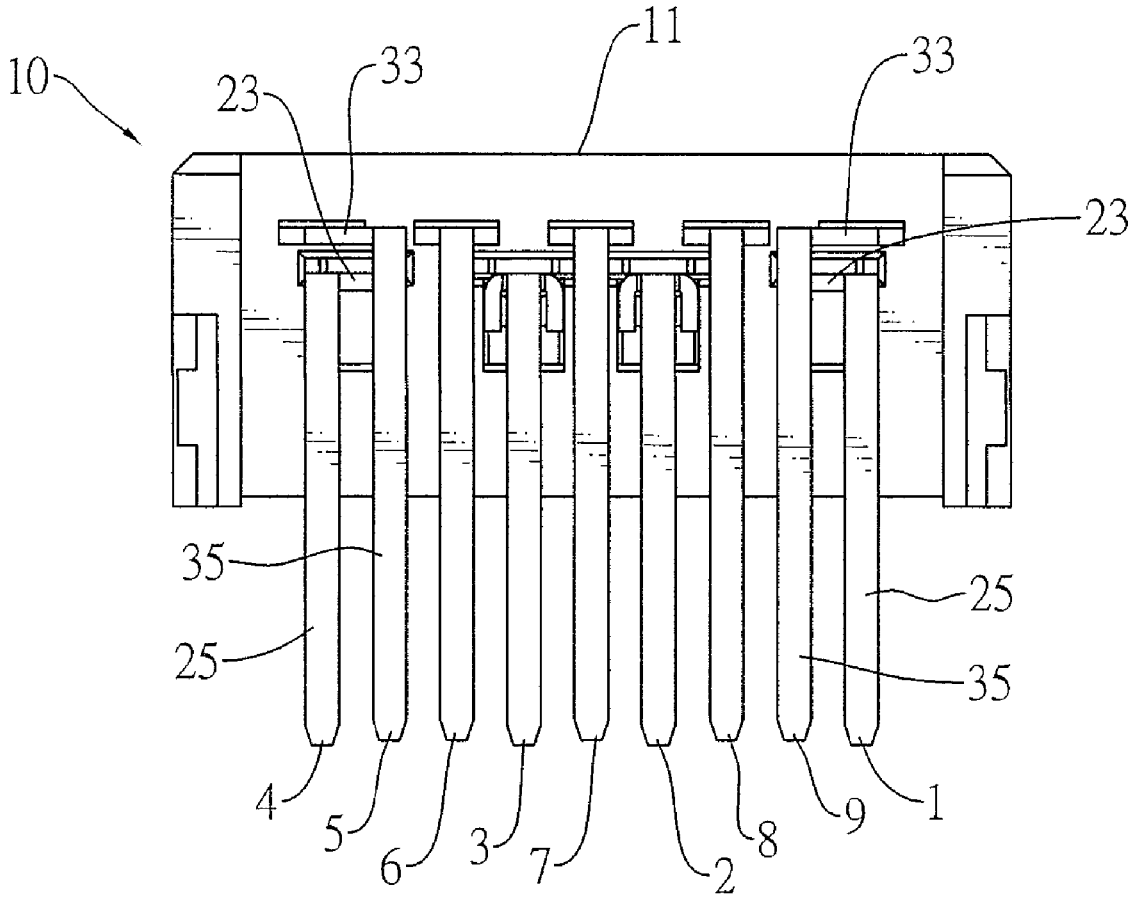
FIG. 12 is a rear view of the connector in FIG. 8.
Figure 13:
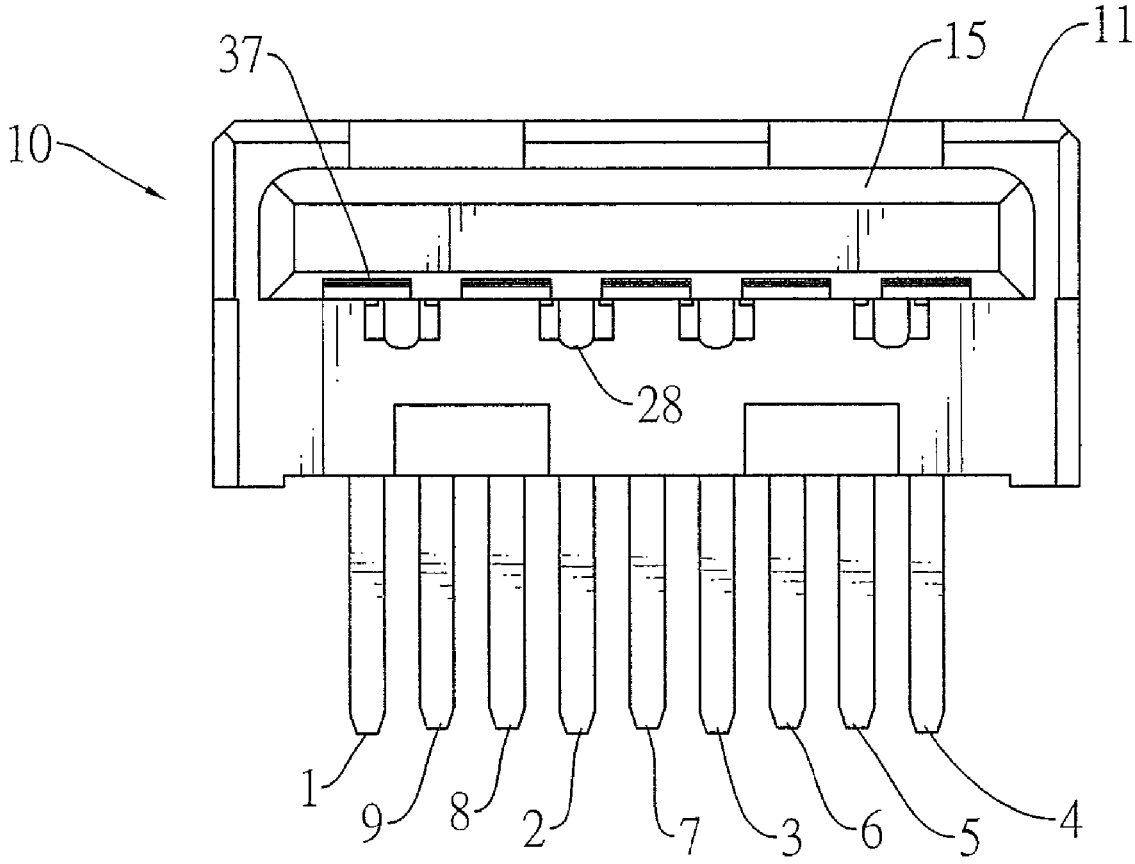
FIG. 13 is a front view of the connector in FIG. 8.

A connector in accordance with the present invention may be a USB 3.0 receptacle connector, may be a T/H type connector (100) (as shown in FIGS. 5 to 14) and may be an SMT type connector (100*a*) (as shown in FIGS. 15 to 24).

With reference to FIGS. 5 to 7 and 14, the T/H type connector (100) in accordance with the present invention is mounted on a PCB (P). The PCB (P) has a front, a rear, a left, a right, a top, a bottom, a first row of through holes (9T, 2T, 3T, 5T) and a second row of through holes (1T, 8T, 7T, 6T, 4T). The first row of the through holes (9T, 2T, 3T, 5T) is defined through the PCB (P) from the top to the bottom and is close to the front of the PCB (P). The second row of the through holes (1T, 8T, 7T, 6T, 4T) is defined through the PCB (P) from the top to the bottom and is close to the rear of the PCB (P). The first and second rows of through holes (1T-9T) are disposed in a staggered arrangement. The through holes (9T, 2T, 3T, 5T) of the first row are numbered No. 9, No. 2, No. 3 and No. 5 from the left to the right. The through holes (1T, 8T, 7T, 6T, 4T) of the second row are numbered No. 1, No. 8, No. 7, No. 6 and No. 4 from the left to the right. The No. 5 through hole (5T) is between the No. 4 through hole (4T) and No. 6 through hole (6T).

The T/H type connector (100) comprises an insulative housing (10), first to ninth terminals (1, 2, 3, 4, 5, 6, 7, 8, 9) and a metal shell (40).

With further reference to FIGS. 8 to 11, the insulative housing (10) has a base (11), a tongue (15), a plurality of lower mounting holes (111), a plurality of upper mounting holes (113), a plurality of grooves (151) and a plurality of openings (153).

The base (11) has a top surface, a bottom surface, two opposite sides and four sets of positioning notches (115, 116, 114). The sets of the positioning notches (115, 116, 114) are defined respectively in the top and bottom surfaces and sides.

The tongue (15) is formed on and protrudes from the base (11) and has a bottom surface and a front end.

The lower mounting holes (111) are defined through the base (11).

The upper mounting holes (113) are defined through the base (11) and are defined in the tongue (15).

The grooves (151) are defined longitudinally in the bottom surface of the tongue (15).

The openings (153) are defined in the bottom surface of the tongue (15) close to the front end and communicate respectively with the upper mounting holes (113).

The first to ninth terminals (1 to 9) are mounted in the insulative housing (10) and are mounted respectively through the No. 1 to 9 through holes (1T to 9T).

The first, second, third and fourth terminals (1 to 4) are similar and each of these terminals (1 to 4) has a mounting section (21), a contacting section (27) and a soldering section (25). The mounting section (21) is mounted in one lower mounting hole (111) of the insulative housing (10). The contacting section (27) is formed on and protrudes forwards and downwards from the mounting section (21), is mounted in one groove (151) and has a contacting tab (28) being V-shaped and extending out of the groove (151). The soldering section (25) is formed on and protrudes perpendicularly down from the mounting section (21) out of the insulative housing (10). The soldering sections (25) of the first, second, third and fourth terminals (1 to 4) are mounted respectively through the No. 1 to 4 through holes (1T to 4T) of the PCB (P).

In a preferred embodiment, the first, second, third and fourth terminals (1 to 4) are respectively a power terminal (PWR), a negative data terminal (UTP_D−), a positive data terminal (UTP_D+) and a grounding terminal (GND_PWRrt).

Furthermore, each of the first and fourth terminals (1, 4) may further have a turning section (23). The turning section (23) is formed between the mounting section (21) and the soldering section (25), protrudes horizontally and transversely outwards from the mounting section (21) relative to the insulative housing (10) and is perpendicular to the soldering section (25). The turning sections (23) locate the soldering sections (25) of the first and fourth terminals (1, 4) outside the mounting sections (21).

The fifth, sixth, seventh, eighth and ninth terminals (5 to 9) are similar and each of these terminals (5 to 9) has a mounting segment (31), a contacting segment (37) and a soldering segment (35). The mounting segment (31) is mounted in one upper mounting hole (113) of the insulative housing (10). The contacting segment (37) is L-shaped, is formed on and protrudes from the mounting segment (31) and extends in one opening (153) of the insulative housing (10). The soldering segment (35) is formed on and protrudes perpendicularly downwards from the mounting segment (31). The soldering segments (35) of the fifth, sixth, seventh, eighth and ninth terminals (5 to 9) are mounted respectively through the No. 5 to 9 through holes (5T to 9T) of the PCB (P).

In a preferred embodiment, the fifth, sixth, seventh, eighth and ninth terminals (5 to 9) are respectively a negative signal receiving terminal (STP_Rx−), a positive signal receiving terminal (STP_Rx+), a drain terminal (STP_Rx_Drain), a negative signal transmitting terminal (STP_Tx−) and a positive signal transmitting terminal (STP_Tx+).

Furthermore, each of the fifth and ninth terminals (5, 9) may further have a turning segment (33). The turning segment (33) is formed between the mounting segment (31) and the soldering segment (35), protrudes horizontally and transversely inwards from the mounting segment (31) relative to the insulative housing (10), is perpendicular to the soldering segment (35) and crosses over one turning section (23). The turning segments (33) locate the soldering segments (35) of the fifth and ninth terminals (5, 9) substantially between the soldering sections (25) of the first and fourth terminals (1, 4).

Figure 14:
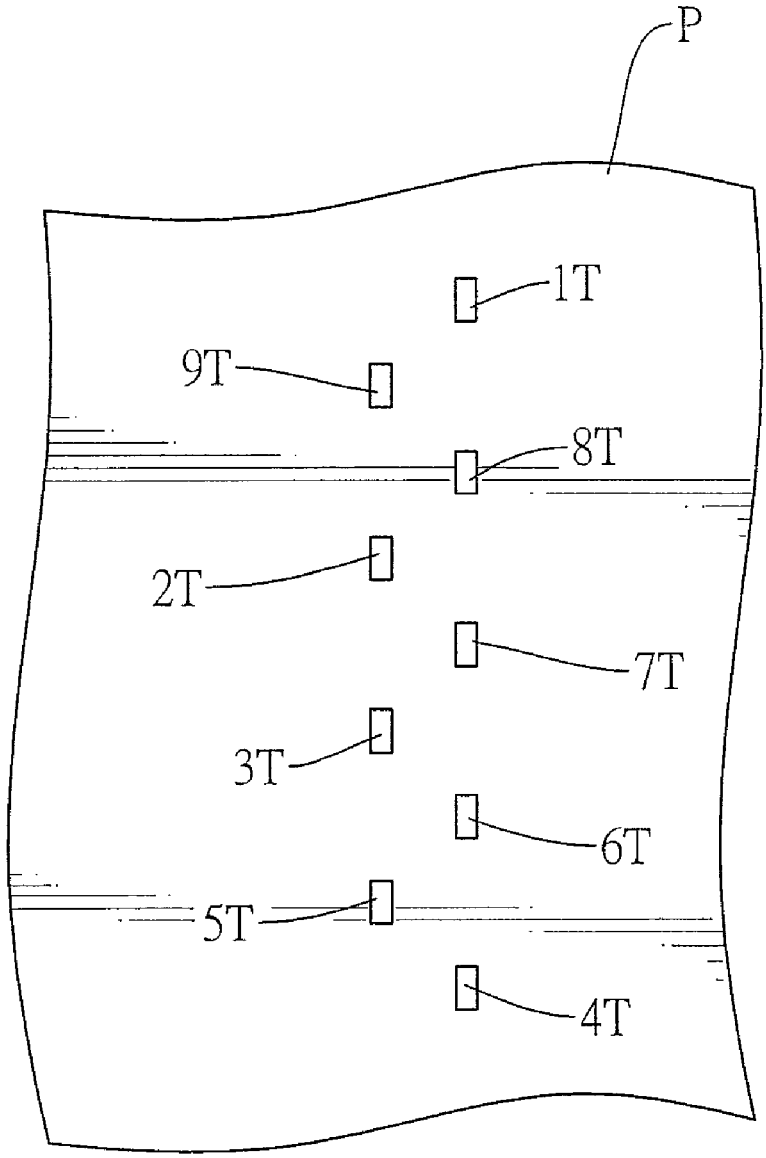
FIG. 14 is a top view of a PCB with through holes corresponding to the soldering sections of the terminals of the connector in FIG. 5.
Figure 15:
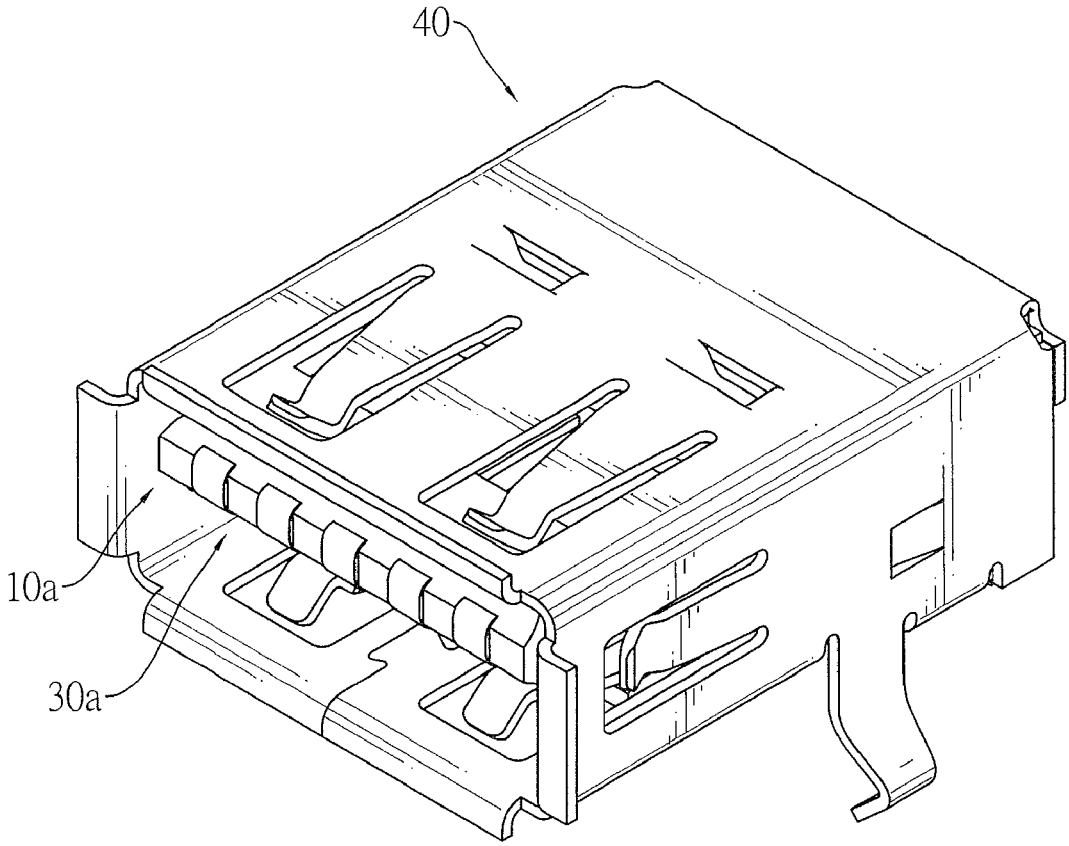
FIG. 15 is a perspective view of a SMT type connector in accordance with the present invention.
Figure 16:
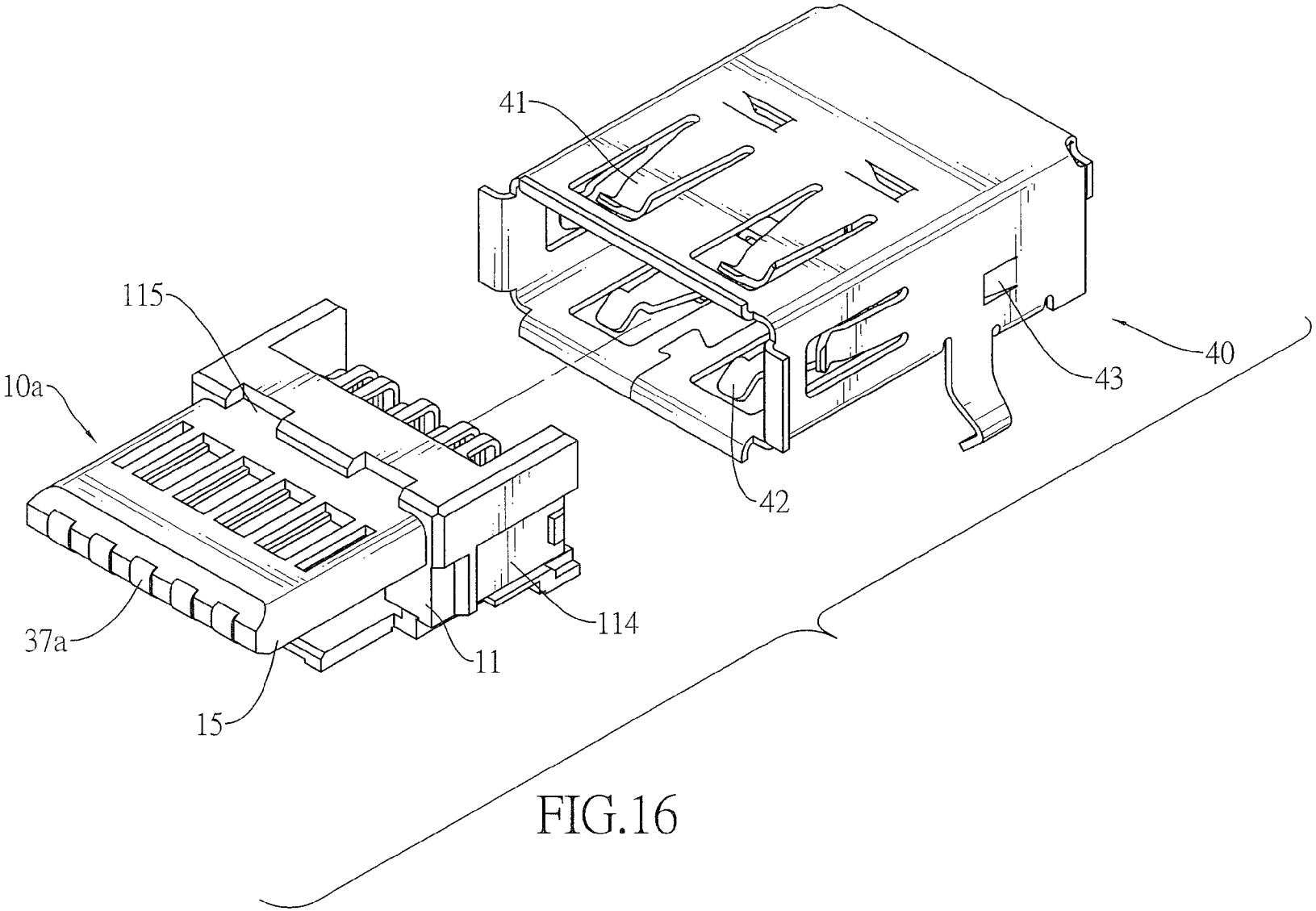
FIG. 16 is a partially exploded perspective of the connector in FIG. 15.

With further reference to FIG. 14, the following Table A indicates the definitions and soldering section arrangement of the terminals (1 to 9).

TABLE A

| Soldering Section (Segment) Arrangement | Definition |
|---|---|
| 1st Terminal (1) | PWR |
| 9th Terminal (9) | STP_Tx+ |
| 8th Terminal (8) | STP_Tx− |
| 2nd Terminal (2) | UTP_D− |
| 7th Terminal (7) | STP_Rx_Drain |
| 3rd Terminal (3) | UTP_D+ |
| 6th Terminal (6) | STP_Rx+ |
| 5th Terminal (5) | STP_Rx− |
| 4th Terminal (4) | GND_PWRrt |

The soldering sections (23) of the power and grounding (first and fourth) terminals (1, 4) are located outside of the soldering sections (23) and segments (33) of remaining terminals (2, 3, 5 to 9) instead of being respectively between the soldering section (23) and segments (33) of signal transmitting or receiving terminals (ninth, eighth, sixth and fifth) (9, 8, 6, 5). Therefore, the power and grounding terminals (1, 4) would not interfere with the signal transmitting and receiving terminals (9, 8, 6, 5).

The metal shell (40) covers the insulative housing (10) and the terminals (1 to 9) and has a top, a bottom, two opposite sides and four sets of positioning tabs (41, 42, 43). The sets of the positioning tabs (41, 42, 43) are formed respectively on the top, bottom and sides of the metal shell (40) and are engaged respectively with the sets of the positioning notches (115, 116, 114) of the base (11).

With further reference to FIGS. 15 to 24, the SMT type connector (100*a*) in accordance with the present invention is similar to the T/H type connector (100) and has terminals slightly different from those of the T/H type connector (100). Therefore, the manufacturing process of the terminals of these connectors (100, 100*a*) may employ a same mold.

The SMT type connector (100*a*) is mounted in a PCB (P). The PCB (P) has a front, a rear, a left, a right, a top, a bottom, a transverse row of solder pads (1P, 2P, 3P, 4P, 5P, 6P, 7P, 8P, 9P). The solder pads (1P to 9P) are numbered No. No. 9, No. 8, No. 2, No 7, No. 3, No. 6, No. 5 and No. 4 from the left to the right.

The SMT type connector (100*a*) comprises an insulative housing (10*a*), first to ninth terminals (1, 2, 3, 4, 5, 6, 7, 8, 9), a positioning bracket (50) and a metal shell (40).

The insulative housing (10*a*) is similar to that of the T/H type connector (100) however has the openings (153*a*) formed on the front end of the tongue (15).

The first to ninth terminals (1 to 9) are mounted on the solder pads (1P to 9P) of the PCB (P).

Semi-finished products of the first to fourth terminals (1 to 4) of the SMT type connector (100*a*) are identical to those of the T/H type connector (100). The first to fourth terminals (1 to 4) of the SMT type connector (100*a*) has the soldering sections (25) further bent to L-shape to have a level section (251) to attach to the No. 1 to No. 4 solder pads (1P to 4P).

Semi-finished products of the fifth to ninth terminals (5 to 9) of the SMT type connector (100*a*) are identical to those of the T/H type connector (100). The fifth to ninth terminals (5 to 9) of the SMT type connector (100*a*) has the soldering sections (35) further bent to L-shape to have a level segment (351) to attach to the No. 5 to No. 9 solder pads (5P to 9P). Furthermore, the contacting segments (37*a*) are U-shaped.

Furthermore, the soldering sections and segments (25, 35) of the terminals (1 to 9) of the SMT type connector (100*a*) are disposed in a transversely straight line, as shown in FIGS. 21 to 24.

Figure 17:
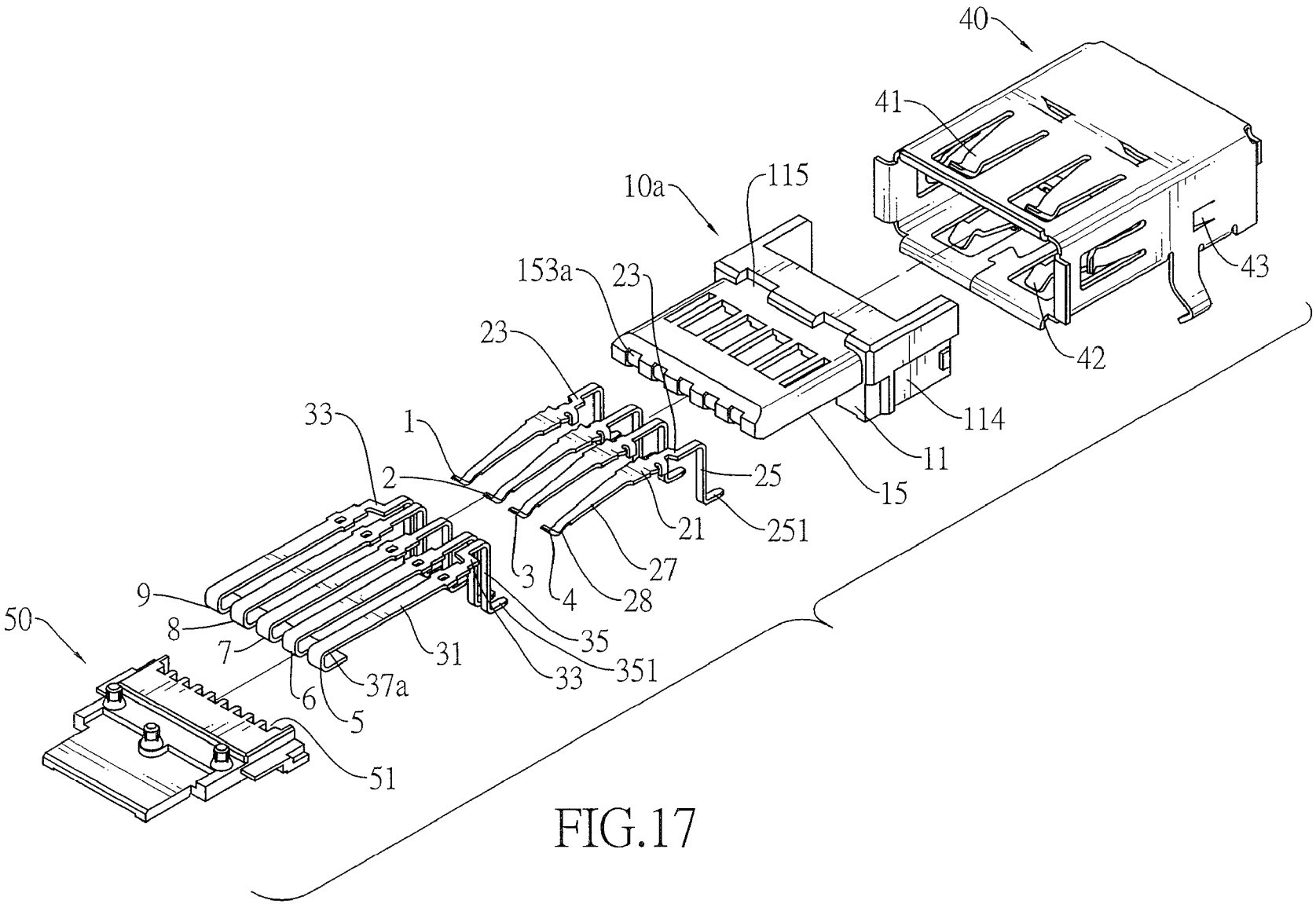
FIG. 17 is an exploded perspective view of the connector in FIG. 15.
Figure 18:
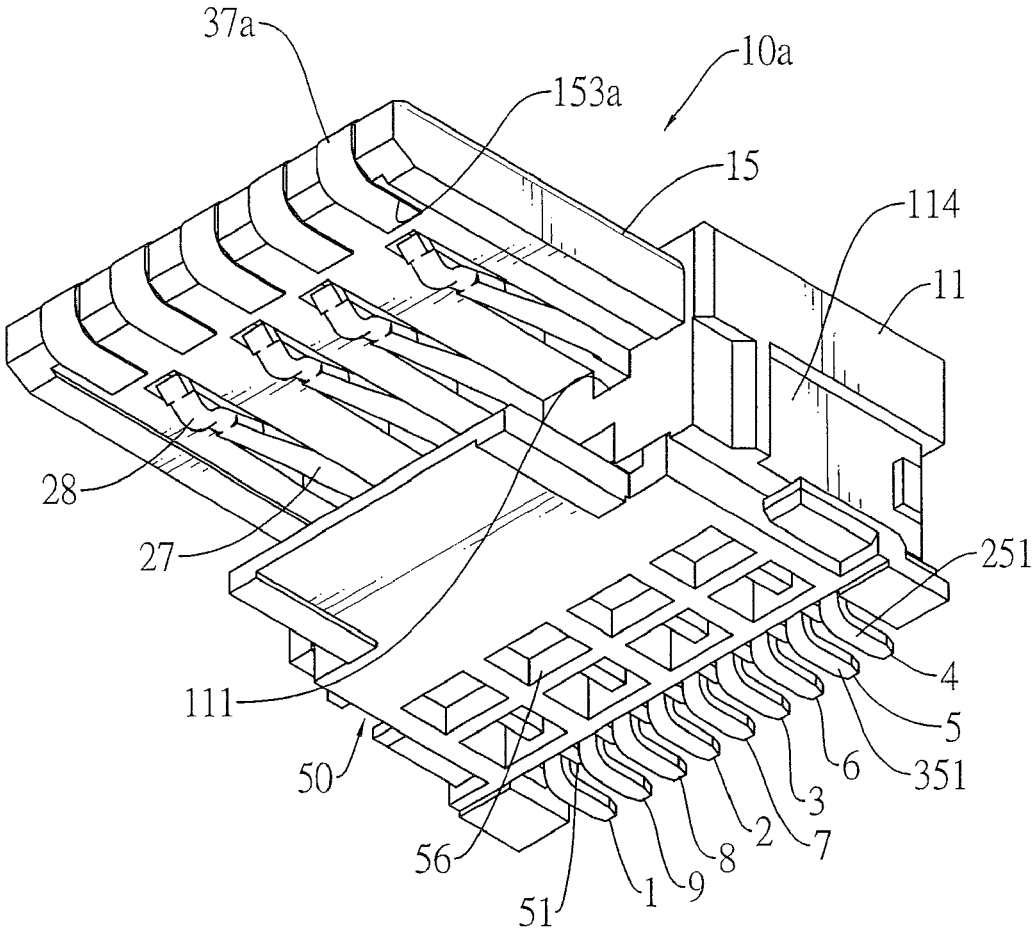
FIG. 18 is a bottom perspective view of the connector in FIG. 15 without the metal shell.
Figure 19:
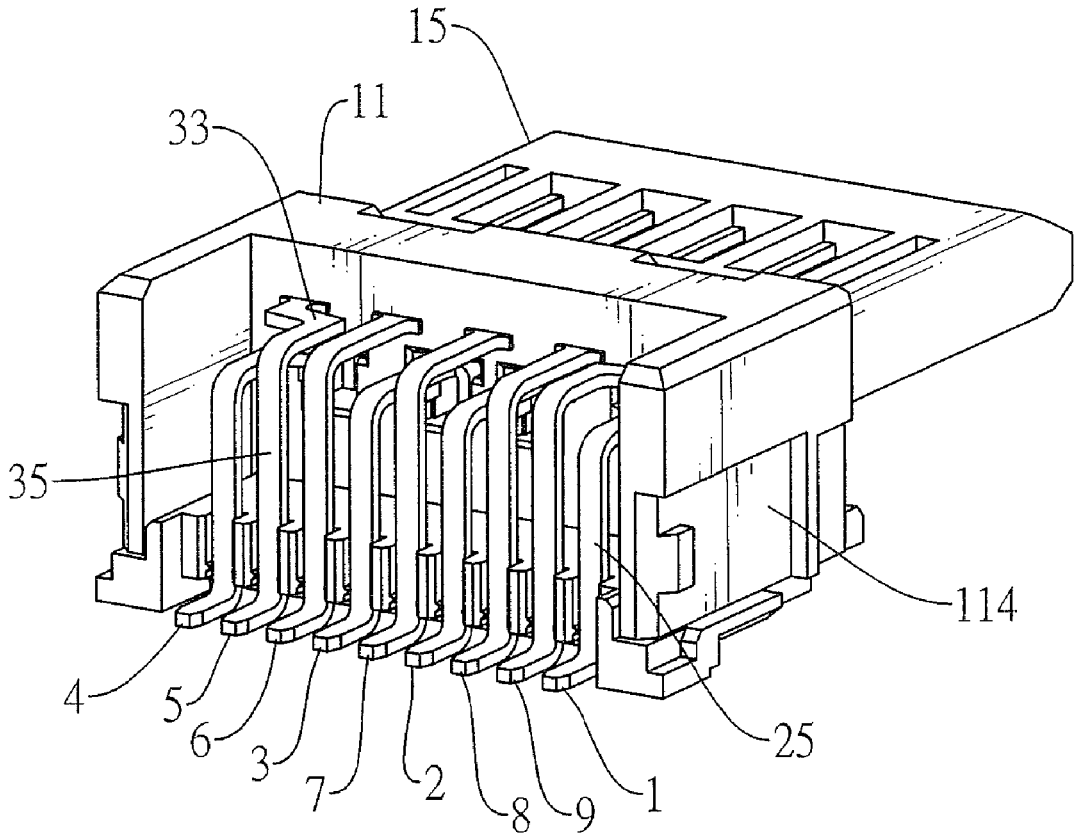
FIG. 19 is a rear perspective view of the connector in FIG. 18.
Figure 20:
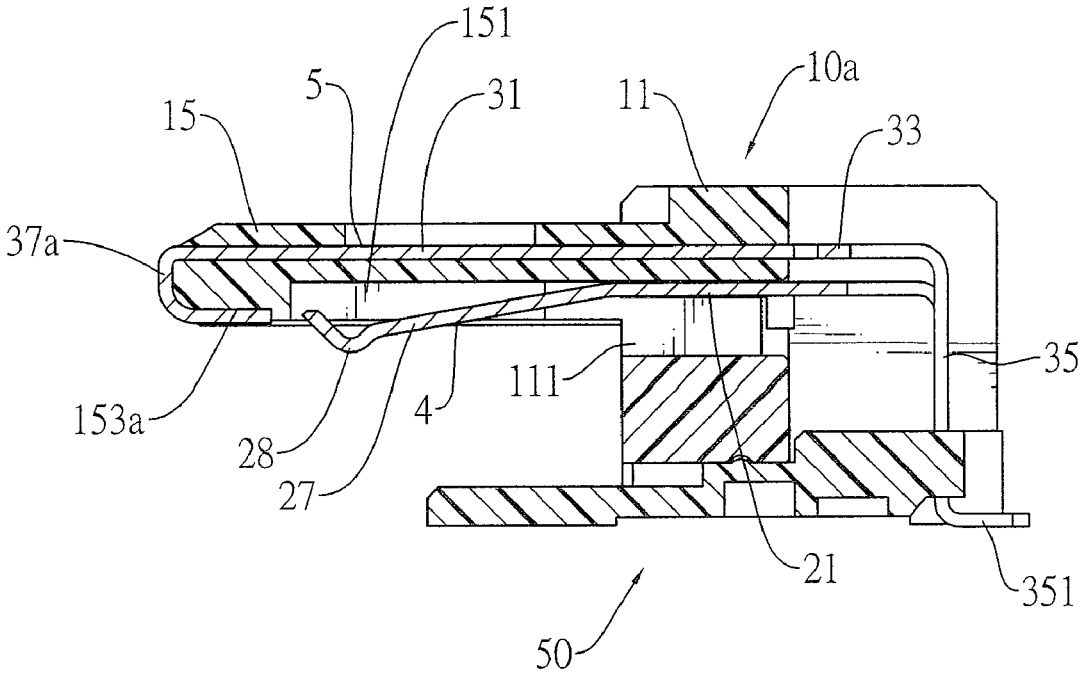
FIG. 20 is a cross sectional side view of the connector in FIG. 18.
Figure 21:
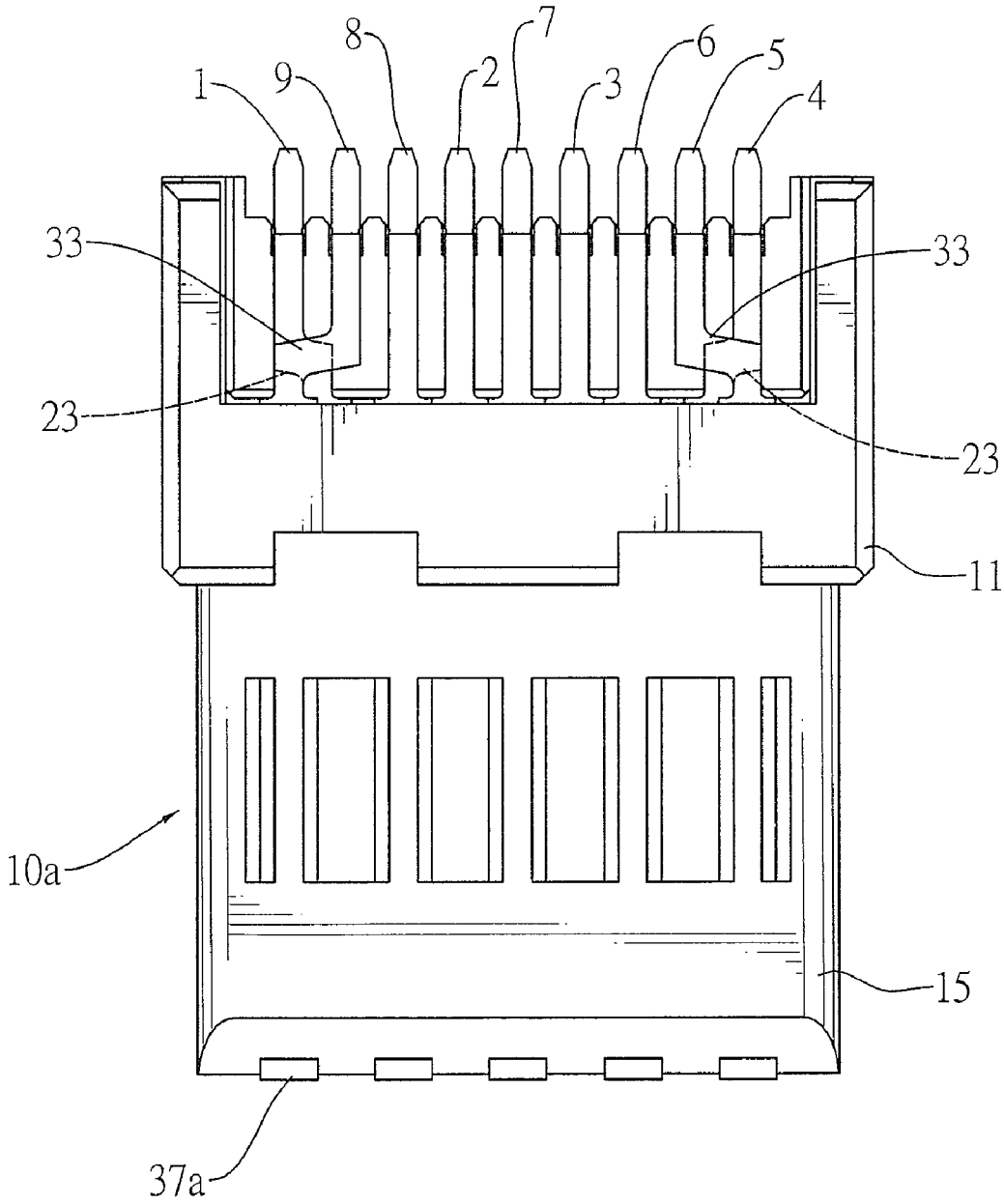
FIG. 21 is a top view of the connector in FIG. 18.
Figure 22:
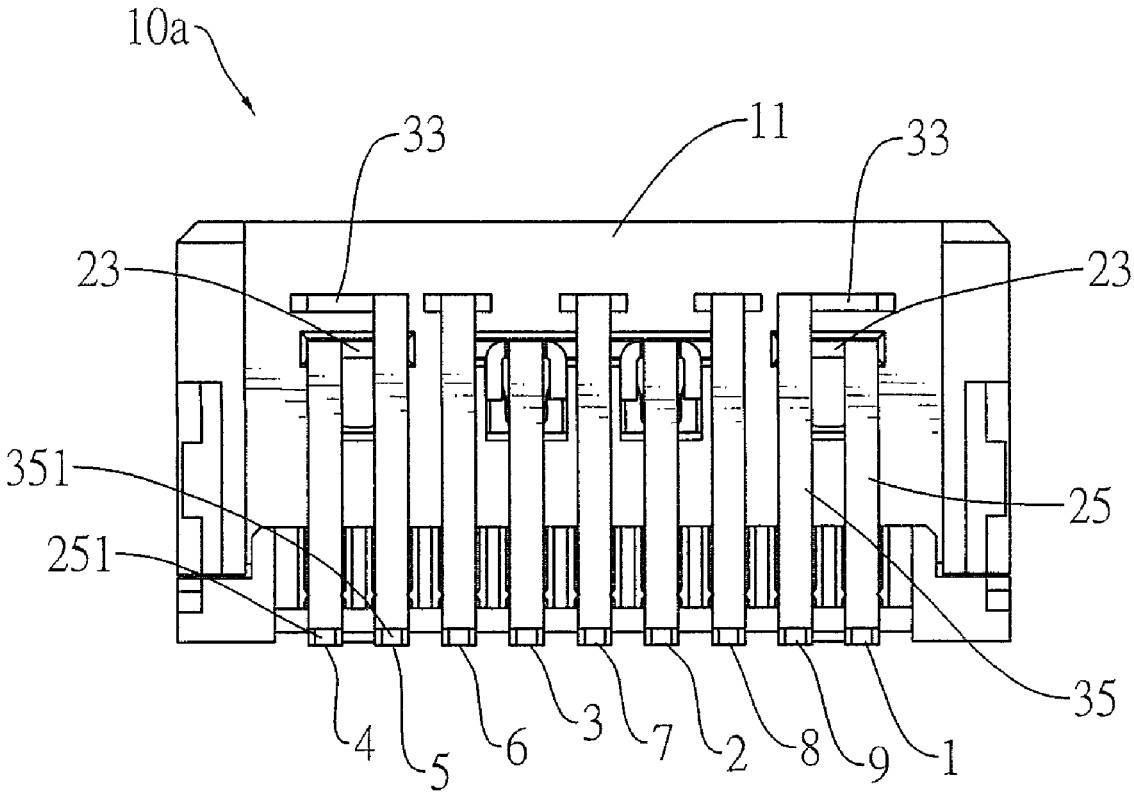
FIG. 22 is a rear view of the connector in FIG. 18.
Figure 23:
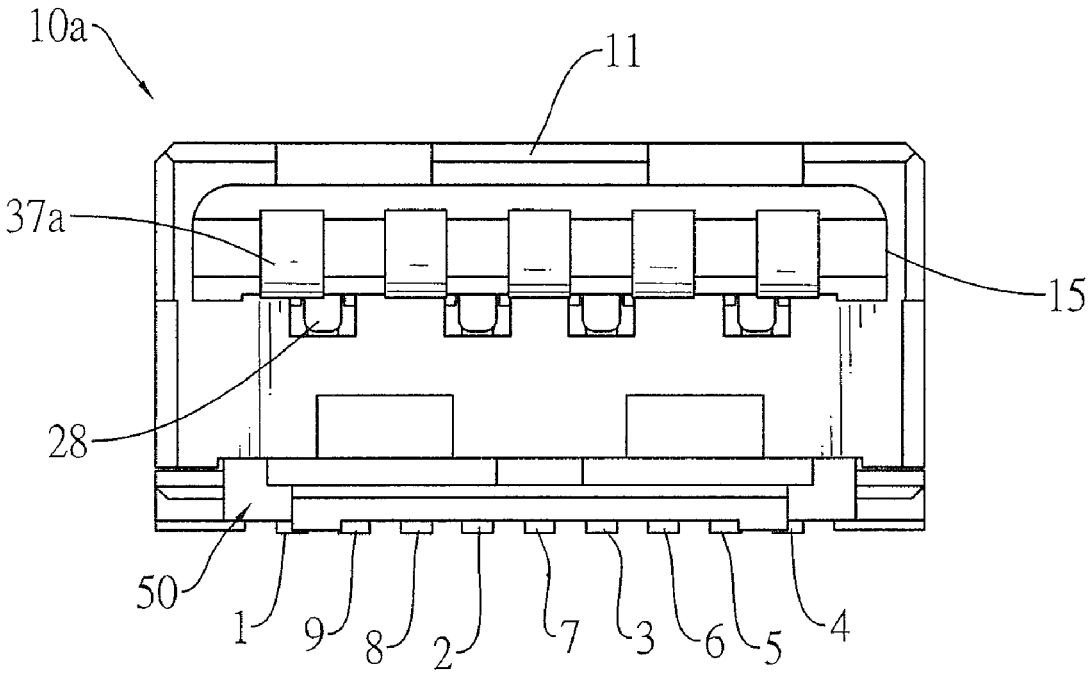
FIG. 23 is a front view of the connector in FIG. 18.
Figure 24:
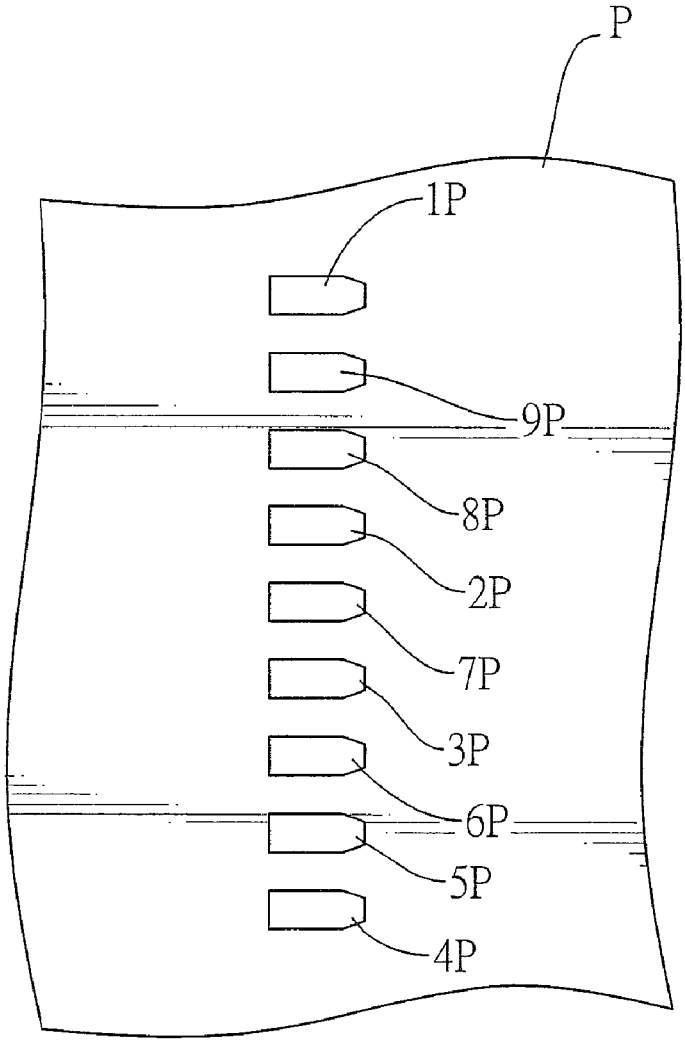
FIG. 24 is a top view of a PCB with solder pads corresponding to the soldering sections of the terminals of the connector in FIG. 15.

The positioning bracket (50) is mounted on the bottom surface of the base (11) and has a plurality of positioning recesses (51) defined in the positioning bracket (50) and respectively holding the soldering sections and segments (25, 35) of the terminals (1 to 9), as shown in FIG. 17.

The metal shell (40) is similar to that of the T/H type connector (100).

The power (first) terminal (1) is an outermost terminal instead of locating between the signal transmitting (ninth and eighth) terminals (8 and 9). The grounding (fourth) terminal (4) is an outermost terminal instead of locating between the signal receiving (sixth and fifth) terminals (5, 6). Therefore, the power and grounding terminals (1, 4) would not interfere with the signal transmitting and receiving terminals (8, 9, 5, 6) so that signal transmission may be implemented successfully and stably.

Furthermore, the terminals (1 to 9) for the T/H and SMT type connectors (100, 100*a*) are manufactured by the same mold and then are selectively bent to form the L-shaped soldering sections and segments (25, 35) depending on whether the SMT connector (100*a*) is fabricated. Also, the contacting segments (37, 37*a*) are selectively formed in L-shape or U-shape depending on the type of the connector. Because terminals for connectors of different types are manufactured by the same mold, the manufacturing cost of the connectors is efficiently lowered.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A connector for being mounted on a PCB (printed circuit board) having a front, a rear, a left, a right and a right and a top, a bottom, a first row and a second row of through holes disposed in a staggered arrangement, the first row of through holes defined through the PCB from the top to the bottom, being close to the front and numbered No. 9, No. 2, No. 3, No. 5 from the left to the right, the second row of the through holes defined through the PCB from the top to the bottom, being close to the rear of the PCB and being numbered No. 1, 8, 7, 6, 4 from the left to the right, the No. 9 through hole located between the No. 1 and No. 8 through holes, the No. 5 through hole located between the No. 4 and No. 6 through holes, the connector comprising:

an insulative housing;

first to ninth terminals mounted in the insulative housing and mounted respectively through the No. 1 to No. 9 through holes, each of the first to fourth terminals having a mounting section, a contacting section and a soldering section, each of the fifth to ninth terminals having a mounting segment, a contacting segment and a soldering segment, the soldering sections mounted respectively through the No. 1 to No. 4 through holes, the soldering segments mounted respectively through the No. 5 to No. 9 through holes, the first terminal being a power terminal and the fourth terminal being a grounding terminal; and a metal shell covering the insulative housing and the first to ninth terminals.

2. The connector as claimed in claim 1, wherein the second, third, fifth, sixth, seventh, eighth and ninth terminals are respectively a negative data terminal, a positive data terminal, a negative signal receiving terminal, a positive signal receiving terminal, a drain terminal, a negative signal transmitting terminal and a positive signal transmitting terminal.

3. The connector as claimed in claim 2, wherein in each of the first to fourth terminals, the contacting section is formed on and protrudes forwards from the mounting section, and the soldering section is formed on and protrudes perpendicularly down from the mounting section; and each of the first and fourth terminals further has turning section formed between the mounting section and the soldering section, protruding horizontally and transversely outwards from the mounting section relative to the insulative housing and being perpendicular to the soldering section.

4. The connector as claimed in claim 3, wherein in each of the fifth to ninth terminals, the contacting segment is formed on and protrudes from the mounting segment, and the soldering segment is formed on and protrudes perpendicularly downwards from the mounting segment; and each of the fifth and ninth terminals further has a turning segment formed between the mounting segment and the soldering segment, protruding horizontally and transversely inwards from the mounting segment relative to the insulative housing, being perpendicular to the soldering segment and crossing over one turning section, wherein the turning segments locate the soldering segments of the fifth and ninth terminals substantially between the soldering sections of the first and fourth terminals.

5. The connector as claimed in claim 4, wherein the insulative housing has a base having a top surface, a bottom surface and two opposite sides; and a tongue formed on and protruding from the base and having a bottom surface and a front end;

a plurality of lower mounting holes defined through the base and respectively holding the mounting sections of the first to fourth terminals; and a plurality of upper mounting holes defined through the base, defined in the tongue and respectively holding the mounting segments of the fifth to ninth terminals.

6. The connector as claimed in claim 5, wherein the insulative housing further having a plurality of grooves defined longitudinally in the bottom surface of the tongue and respective holding the contacting sections of the first to fourth terminals.

7. The connector as claimed in claim 6, wherein the insulative housing further has a plurality of openings defined in the bottom surface of the tongue close to the front end, communicating respectively with the upper mounting holes and in which the contacting segments extend respectively.

8. The connector as claimed in claim 7, wherein each contacting section has a contacting tab being V-shaped and extending out of one groove.

9. The connector as claimed in claim 8, wherein each contacting segment is L-shaped.

10. A connector for being mounted on a PCB having a front, a rear, a left, a right and a right and a top, a bottom and a transverse row of solder pads numbered No. 1, No. 9, No. 8, No. 2, No. 7, No. 3, No. 6, No. 5 and No. 4 from the left to the right, the connector comprising:

an insulative housing;

first to ninth terminals mounted in the insulative housing and mounted respectively through the No. 1 to No. 9 through holes, each of the first to fourth terminals having a mounting section, a contacting section and a soldering section, each of the fifth to ninth terminals having a mounting segment, a contacting segment and a soldering segment, the soldering sections mounted respectively through the No. 1 to No. 4 through holes, the soldering segments mounted respectively through the No. 5 to No. 9 through holes, the soldering sections and segments arranged in a transversely straight line, the first terminal being a power terminal and the fourth terminal being a grounding terminal; and a metal shell covering the insulative housing and the first to ninth terminals.

11. The connector as claimed in claim 10, wherein the second, third, fifth, sixth, seventh, eighth and ninth terminals are respectively a negative data terminal, a positive data terminal, a negative signal receiving terminal, a positive signal receiving terminal, a drain terminal, a negative signal transmitting terminal and a positive signal transmitting terminal.

12. The connector as claimed in claim 11, wherein in each of the first to fourth terminals, the contacting section is formed on and protrudes forwards from the mounting section, and the soldering section is formed on and protrudes perpendicularly down from the mounting section; and each of the first and fourth terminals further has turning section formed between the mounting section and the soldering section, protruding horizontally and transversely outwards from the mounting section relative to the insulative housing and being perpendicular to the soldering section.

13. The connector as claimed in claim 12, wherein in each of the fifth to ninth terminals, the contacting segment is formed on and protrudes from the mounting segment, and the soldering segment is formed on and protrudes perpendicularly downwards from the mounting segment; and each of the fifth and ninth terminals further has a turning segment formed between the mounting segment and the soldering segment, protruding horizontally and transversely inwards from the mounting segment relative to the insulative housing, being perpendicular to the soldering segment and intersecting one turning section, wherein the turning segments locate the soldering segments of the fifth and ninth terminals between the soldering sections of the first and fourth terminals.

14. The connector as claimed in claim 13, wherein the insulative housing has a base having a top surface, a bottom surface and two opposite sides; and a tongue formed on and protruding from the base and having a bottom surface and a front end;

a plurality of lower mounting holes defined through the base and respectively holding the mounting sections of the first to fourth terminals; and a plurality of upper mounting holes defined through the base, defined in the tongue and respectively holding the mounting segments of the fifth to ninth terminals.

15. The connector as claimed in claim 14, wherein the insulative housing further having a plurality of grooves defined longitudinally in the bottom surface of the tongue and respective holding the contacting sections of the first to fourth terminals.

16. The connector as claimed in claim 15, wherein the insulative housing further has a plurality of openings defined in the bottom surface of the tongue close to the front end, communicating respectively with the upper mounting holes and in which the contacting segments extend respectively.

17. The connector as claimed in claim 16, wherein each contacting section has a contacting tab being V-shaped and extending out of one groove.

18. The connector as claimed in claim 17, wherein each contacting segment is U-shaped.

19. The connector as claimed in claim 18 further comprising a positioning bracket mounted on the bottom surface of the base and having a plurality of positioning recesses defined in the positioning bracket and respectively holding the soldering sections and segments.

* * * * *